US005711216A

United States Patent [19]

Tiemann et al.

[11] Patent Number: 5,711,216

[45] Date of Patent: Jan. 27, 1998

[54] APPARATUS FOR DECORATING ARTICLES

[75] Inventors: Gerhard Tiemann, Löhne; Joachim Hellmeier, Rödinghausen, both of Germany

[73] Assignee: Werner Kammann Maschinenfabrik GmbH, Bunde, Germany

[21] Appl. No.: 806,767

[22] Filed: Feb. 26, 1997

[30] Foreign Application Priority Data

Mar. 1, 1996 [DE] Germany ..... 196 07 837.7

[51] Int. Cl.[6] ..... B41F 17/08

[52] U.S. Cl. ..... 101/40.1; 101/118; 198/850; 198/803.3; 198/803.6

[58] Field of Search ..... 101/35, 36, 37, 101/38.1, 39, 40, 40.1, 41, 44, 53, 118, 115; 198/793, 803.3, 803.6, 836.1, 844.2, 850, 851

[56] References Cited

U.S. PATENT DOCUMENTS

| | | | |
|---|---|---|---|
| 2,077,647 | 4/1937 | Stokes et al. | 101/44 |
| 2,207,351 | 7/1940 | McLaughlin et al. | 101/40.1 |
| 2,261,255 | 11/1941 | Jackson | 101/40.1 |
| 3,543,680 | 12/1970 | Killen et al. | 101/40 |
| 4,263,846 | 4/1981 | Eldred et al. | 101/40 |
| 4,750,419 | 6/1988 | Merideth | 101/40 |
| 5,471,924 | 12/1995 | Helling | 101/38.1 |

*Primary Examiner*—Eugene H. Eickholt

*Attorney, Agent, or Firm*—Panitch Schwarze Jacobs & Nadel, P.C.

[57] ABSTRACT

An apparatus for decorating articles comprises a transport path with at least one decorating station, and at least one article carrier displaced by a circulating transport system along the transport path. The transport system circulates in a horizontal plane and comprises a plurality of rigid rack portions which are interconnected pivotably in the horizontal plane. The transport system is driven by way of a gear. The transport system is guided by guide rollers mounted on a connecting pivot connecting each two adjacent rigid rack portions and they co-operate with guide rails defining at least a portion of the transport path.

23 Claims, 8 Drawing Sheets

A
B
C
D
E
F
G
K
II
III
VI
10
11
12
14
15
16
18
19
20
25,26,27,28
30,35
32,34
36
37
39
40
42
43
44
46
47
50
56
64
65
73
88
89
90
92
94

APPARATUS FOR DECORATING ARTICLES

FIELD OF THE INVENTION

The invention concerns an apparatus for decorating individual articles, for example using more particularly a screen printing process wherein a plurality of print images can be successively applied to the individual article to supplement each other to make up an overall print image. The articles may be for example bottles, glasses or other hollow bodies or containers.

BACKGROUND OF THE INVENTION

U.S. Pat. specification No. 4,109,573 discloses an apparatus for decorating individual articles using a screen printing process, in which the articles are held by a pair of chains and are passed by the chains through a plurality of printing stations which are arranged in succession in the direction of transportation movement of the pair of chains. In that case the articles are also held by the chains during the printing procedure. That apparatus has proved its worth for multicolor decoration, especially as the continuous movement of the chains means that it is possible to achieve a high level of productivity even when the apparatus has a relatively large number of printing stations through which the articles pass in succession, with an individual print image being applied to each article in each printing station. However a disadvantage of that apparatus is that it is very long when it has more than three or four printing stations. Furthermore, the situation can arise where the degree of accuracy with which the individual article is aligned relative to the individual printing stations and thus relative to the respective screen printing stencil disposed therein no longer satisfies the requirements which are usually imposed nowadays in terms of quality of the multi-color printing effect. That is generally to be attributed in particular to the fact that certain tolerances occur due to the large number of chain link members and the connections which are accordingly necessary therebetween, especially as a certain amount of wear is inevitable in the course of time, and that also gives rise to tolerances which furthermore cannot be accurately predicted. On the other hand, with this design of machine having a pair of chains as a means for transporting and holding the articles, it is possible to employ a modular mode of construction, for example in such a way that a printing station is associated with each module and a suitable number of modules is assembled together in accordance with the respective requirements involved, that is to say the number of individual print images to be applied to each article to constitute an overall print image. It is then only necessary to adapt the pair of chains to the respective requirements, that is to say the overall length of the totality of the modules.

In comparison, a higher degree of accuracy in regard to alignment of the individual articles with respect to the respective printing stations is afforded by machines in which the transport element for transporting the articles through the machine is in the form of a rigid carrier which circulates generally in a horizontal plane on a circular path and which for example can be in the form of a circular table or wheel. Such machines also have a high level of productivity, in particular when the table or the like component rotates continuously, as is the case for example with the machine disclosed in U.S. Pat. No. 4,750,419. A disadvantage however of those machines provided with a table which rotates about a fixed point is that they are inflexible in terms of their dimensions and thus also in respect of the space for arranging printing stations and/or other treatment stations. The space available at the periphery of the table or like rotating component, for disposing the treatment station, is generally determined by the diameter of the table or the like rotating component, and that diameter normally cannot be altered. In addition machines of that kind suffer from the disadvantage that an increasing number of treatment stations in the machine generally also causes an increase in the diameter of the machine, and in extreme cases the machine may achieve dimensions which make it difficult to transport such a machine or which even make it necessary to dismantle the machine for the purposes of transportation thereof.

SUMMARY OF THE INVENTION

An object of the present invention is to provide an apparatus for decorating articles which at least markedly reduces the disadvantages of the above-discussed machines.

Another object of the present invention is to provide an apparatus for decorating articles which is of a simple and clearly planned design configuration and which is less susceptible to trouble in operation thereof.

Still another object of the present invention is to provide an apparatus for decorating articles which affords enhanced flexibility in terms of treatments to be applied to articles passing through the apparatus.

A still further object of the present invention is an apparatus for decorating articles that permits an article to be decorated to be rotated if required in a decorating station about the longitudinal axis of the article or an axis parallel thereto independently of movements of the decorating mechanism.

In accordance with the principles of the present invention the foregoing and other objects are achieved by an apparatus for decorating articles such as for example bottles, glasses and other hollow bodies or containers, comprising a transport path and at least one station in which an article can be treated such as decorated therein. The apparatus includes at least one article carrier movable along the transport path. It has a station at which an article to be decorated is fed to the article carrier and a station at which a decorated article is removed from the article carrier. The apparatus includes a circulating transport means for the at least one article carrier, the transport means comprising a plurality of rigid elongate transport portions which are pivotably connected together in the plane in which the transport means circulates. The transport portions of the transport means circulating in a substantially horizontal plane are provided with tooth means. At least one drive means has tooth means in engagement with the tooth means of at least one said transport portion of the circulating transport means in order to move the transport means along the transport path. The transport portions of the transport means are guided by way of the connecting means pivotably interconnecting each two adjacent transport portions on at least one guide means defining at least a portion of the transport path.

In a preferred feature the transport portions are in the form of racks provided at one side with tooth means, while the article carrier is advantageously mounted at the side opposite the tooth means.

The transport path preferably comprises first and second substantially linear, mutually parallel, spaced-apart portions and first and second curved portions which connect the first and second mutually parallel portions, wherein at least one decorating or printing station is associated with each of the first and second substantially linear portions. In the substantially linear portions of the transport path, the racks run substantially parallel to the transport path which can be defined by stationary guide rails. In the curved portions of the transport path on the other hand the racks form a polygon which in those portions is not coincident with the configuration of the transport path or the guides along which the guide means carried by the racks move. The drive means for the transport means on the one hand, and the guide means on the other hand, are independent of each other.

The apparatus according to the invention is generally provided with two or more stations at which a print image is applied to a respective article. As it passes along the transport path the article is passed through the successive decorating or printing stations and possibly also further treatment stations, in which procedure a partial print image is applied to the article in each printing station, with all the partial print images supplementing each other to make up an overall print image. That is for example generally conventional procedure in multi-color screen printing processes. It is however also possible to print on different regions of the article, in the respective printing stations, in which case those regions may also involve different radii. If for example the article is a bottle, the regions thereof to which printing or decoration is to be applied may be for example the body of the bottle which is of a given radius and the neck of the bottle whose region to be printed upon or decorated is generally of a smaller diameter or radius than the body of the bottle. It is in no way necessary for the regions to be printed upon or decorated to be of a cylindrical cross-section but rather it is also possible to decorate articles, by means of screen printing, which are of an approximately elliptical cross-section or which have elliptical cross-sectional regions.

As the regions of the article which are to be decorated or printed upon, being curved around an axis parallel to the longitudinal axis of the article, may involve different radii, it may be preferable to provide means for adjusting the speed of rotation of the article about its longitudinal axis or an axis parallel thereto, in dependence on the radius of the surface to be printed upon or decorated. If that surface extends in an arcuate configuration, it is rolled against the screen printing stencil in the printing procedure. In that case, the peripheral speed of the surface to be printed upon must correspond to the speed of transportation movement of the article, produced by the transport means of the apparatus, in order to produce a good print image quality. In general the rotary or pivotal movement of the article, which is required in the printing operation, is transmitted to the article by way of the holder which carries the article and which in turn is mounted on the article carrier. The holder is generally provided with a gear engaging with a drive means for driving the gear at a speed corresponding to the desired peripheral speed of the article during the printing procedure. In addition, by way of that gear and the drive means associated therewith, the article is oriented in the peripheral direction for each printing operation so that the respective print image is also correctly positioned on the article and, for example when the situation involves a plurality of partial print images which are to be printed one upon the other, they properly supplement each other in accurate relationship to make up the overall print image. In this respect, in accordance with a further preferred feature of the invention, the gear for the holding portion accommodating the article is driven using a cam means which extends along at least a portion of the transport path and in the course of the transport movement of the article along the transport path transmits movements to the means for driving the gear, which is generally in the form of a rack. The configuration of the cam means must therefore be so selected in each printing station that the rotary movement of the gear and thus the article, as is caused by the rack, results in the desired peripheral speed thereof. When the apparatus has a plurality of printing or other treatment stations which are arranged in succession in the direction of transportation movement through the apparatus, the individual cam portions associated with each station can supplement each other to form an overall cam means into which engages for example a cam roller mounted on the rack. It is however also possible to provide spacings between the cam portions which are associated with the individual stations. It is then only necessary to ensure that, when it passes into the respectively following cam portion, the cam roller assumes the position required for that purpose. At any event it is possible for an individual cam portion to be associated with each station, and thus if necessary to provide that the articles perform different rotary or pivotal movements in the individual stations. In that way the invention affords an advantageous combination as on the one hand the articles are guided through all stations by the article carrier which receives the respective article at the feed station of the apparatus and they only need to be removed from the apparatus after the last treatment has been performed. That permits the articles to be transported through all stations in a highly uncomplicated manner, as each individual article is carried by the same article carrier during its entire passage through the apparatus. On the other hand the use of the cam means for transmitting the rotary or pivotal movements to the articles, in particular during the decorating or printing procedures, permits adaptation to the individual requirements involved in each station, thus making it possible to achieve a very high degree of flexibility.

The apparatus according to the invention is particularly suitable for articles which during the printing operation can roll against the screen printing stencil used for the procedure, as in that case it is possible to operate with stationary screen printing stencils. The apparatus however is also suitable for dealing with articles whose surface to be printed upon is substantially flat and cannot therefore be rolled against the screen printing stencil. In that case of course each screen printing stencil would have to be moved during the printing operation if the articles are continuously transported along the transport path of the apparatus.

Further objects, features and advantages of the invention will be apparent from the following description of a preferred embodiment of the invention.

DESCRIPTION OF THE PREFERRED EMBODIMENT

Figure 1:
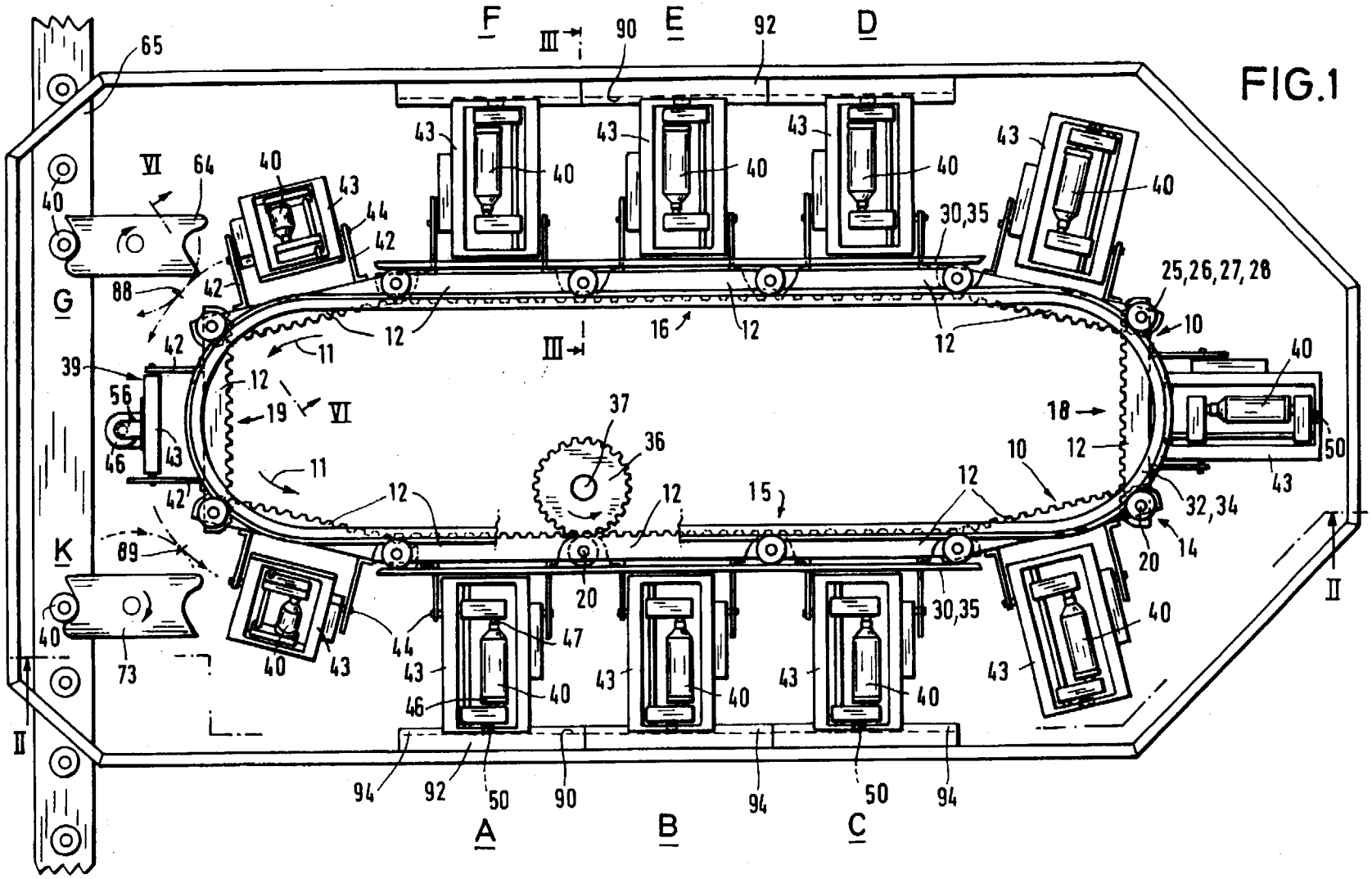
FIG. 1 is a diagrammatic plan view of an apparatus in the form of a screen printing machine.

Referring first generally to FIG. 1, shown therein is an apparatus for decorating articles such as for example bottles, glasses or other hollow bodies or containers, illustrated in the form of a screen printing machine having a transport means 10 which circulates in an at least substantially horizontal plane and which comprises twelve transport portions in the form of racks 12 which are pivotably connected together at their ends by pivots or hinges 14 in such a way that they are pivotable relative to each other only in the horizontal plane in which the transport means circulates. The transport means 10 is guided at the pivots 14 along a transport path comprising first and second linear, mutually parallel, spaced-apart portions 15 and 16, and first and second arcuately curved portions 18 and 19 which extend approximately in a semi-circular configuration and which interconnect the first and second linear transport path portions 15 and 16. The transport means can be viewed as a chain which is composed of the racks 12, although few connecting links or pivots are required by virtue of the length of the respective racks. All pivots or hinges 14 follow the transport path 15, 16, 18 and 19 in the course of the circulatory movement of the transport means 10. In contrast, when making the transition from the linear transport path portion 15 by way of the transport path portion 18 into the second linear transport path portion 16, the racks 12 describe a path of movement which differs from the configuration of the transport path portion 18, as FIG. 1 particularly clearly shows. A corresponding consideration applies in the transition from the second linear transport path portion 16 by way of the arcuate transport path portion 19 into the linear transport path portion 15.

In the case of the embodiment illustrated in the drawing, the linear transport path portions 15 and 16 are each of a length which corresponds to that of three racks 12 which are connected together by way of the connecting pivots 14. The racks may be of a length which is between about 200 mm and 1000 mm, for example between about 500 mm and 700 mm. In the position of the transport means 10 shown in FIG. 1, there are three racks which form a polygon in the region of each of the curved transport path portions 18, 19. The two racks 12 which respectively adjoin the racks extending perpendicularly with respect to the path portions 15 and 16 are somewhat angled relative to the linear path portions 15 and 16. It will be apparent that, in the course of the movement of the transport means 10 in the transportation direction as indicated by the arrows 11 in FIG. 1, the positions of the racks 12 forming the respective polygons will alter. The position of the transport means 10 shown in FIG. 1 however determines the minimum spacing between the two linear transport path portions 15, 16 which depends on the length of each respective rack 12. When printing on or decorating articles which in the printing or decorating procedure perform a pivotal or rotary movement about their longitudinal axis, the length of the racks 12 will also depend on the radius of the surface to be printed upon or decorated. At any event the endeavour will be to provide the transport means 10 only with such a number of racks as is required to achieve the desired result, as, with a given length of transport means, the number of racks 12 determines the number of connecting pivots 14 and thus the tolerances which have to be accepted.

Figure 8:
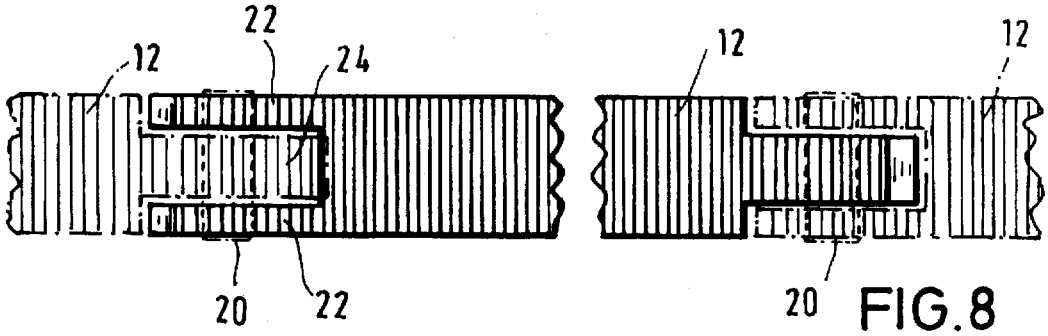
FIG. 8 is a view approximately in the direction of the arrow VIII in FIG. 7.
Figure 7:
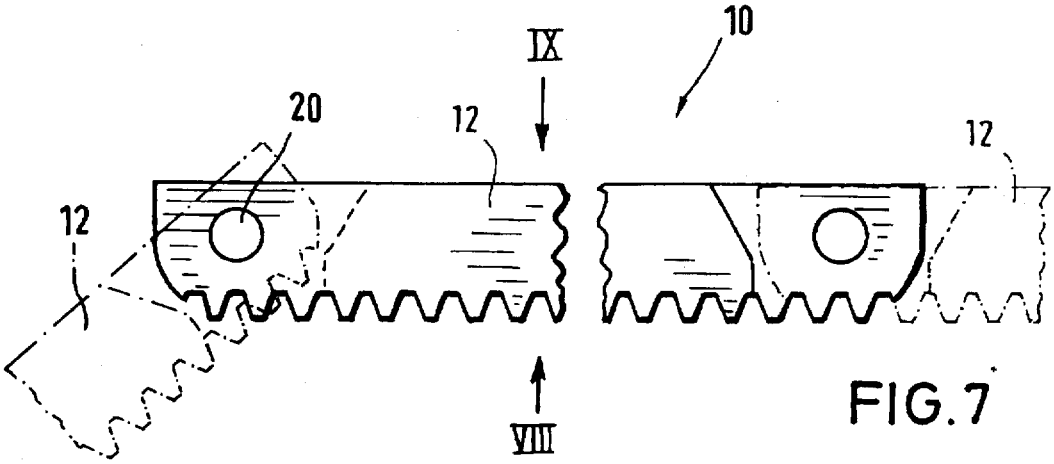
FIG. 7 is a plan view of a portion of the transport means.
Figure 9:
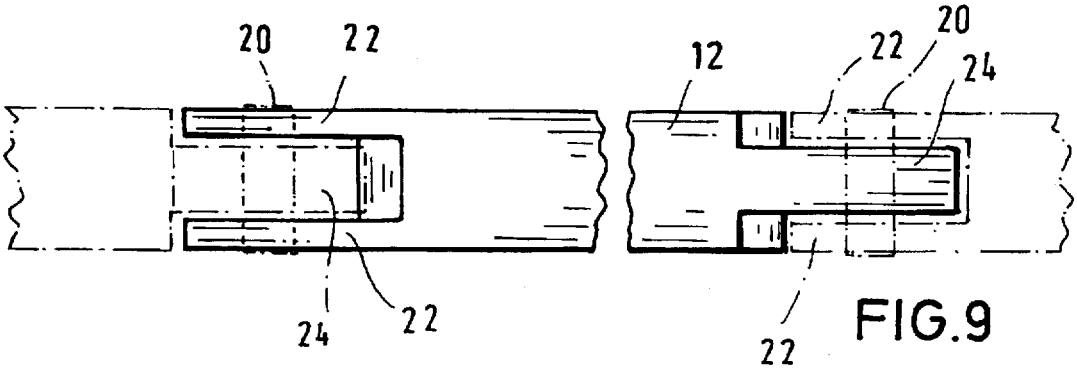
FIG. 9 is a view approximately in the direction of the arrow IX in FIG. 7.

The connecting pivots between the individual racks 12 are each provided with a substantially vertical pivot pin or bolt as indicated at 20 in FIG. 1, referred to herein for the sake of simplicity as the pivot pin 20, and as shown in greater detail in FIGS. 7 through 9. Each pivot pin 20 is passed through the respective adjoining racks to be connected together. As can be seen from FIGS. 7 through 9, each rack 12 of the transport means 10 is provided at one end with a fork portion 22 and at the other end with a portion 24 of reduced thickness, in such a way that the portion 24 can be inserted between the two parts of the fork portion 22 of the respectively adjacent rack 12. Both the fork portion 22 and also the portion 24 are provided with a bore with a close tolerance for the connecting pin 20 to pass therethrough.

Figure 3:
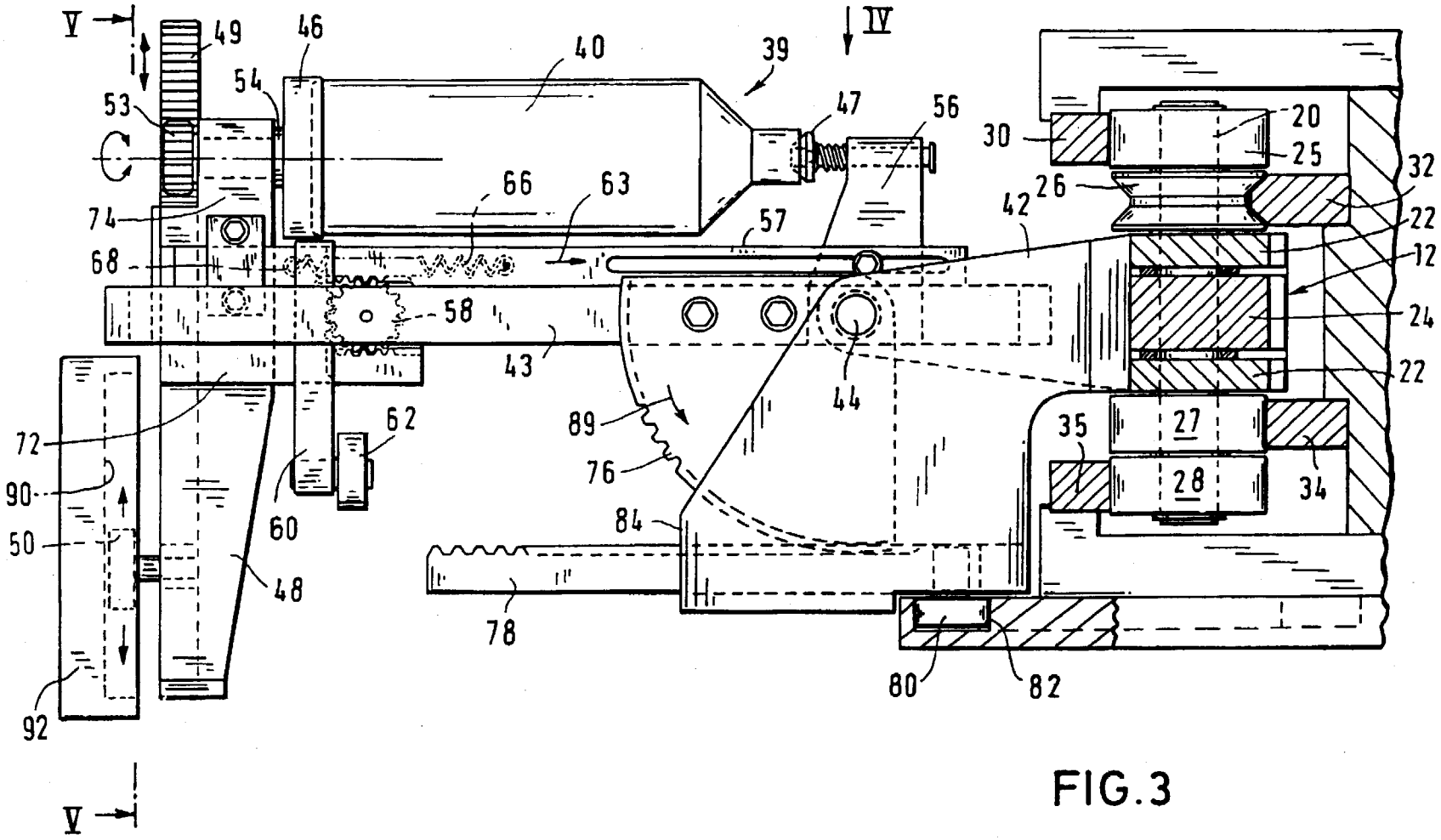
FIG. 3 is a view approximately in the direction of the arrows III—III in FIG. 1.
Figure 5:
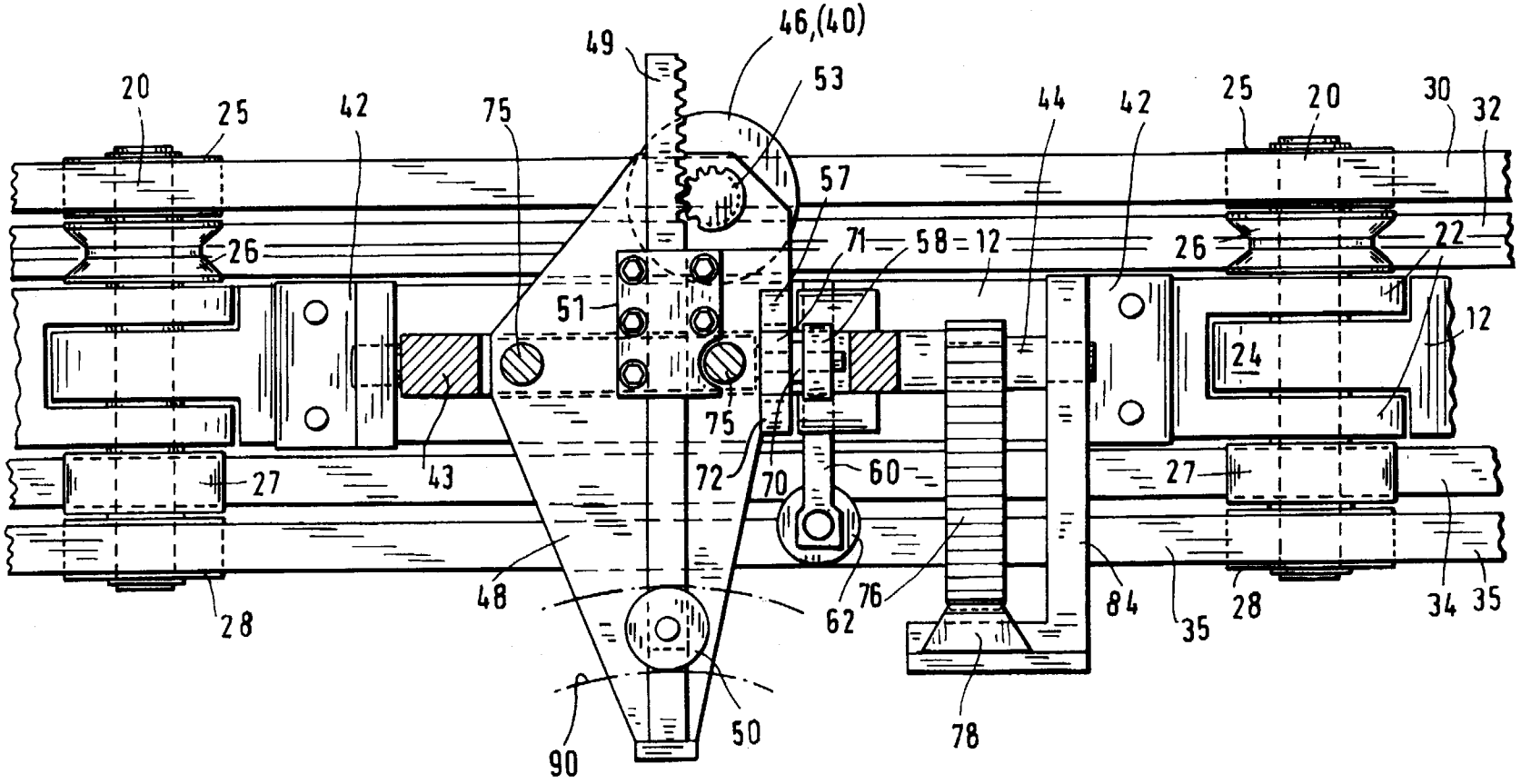
FIG. 5 is a view approximately in the direction of the arrows V—V in FIG. 3.
Figure 6:
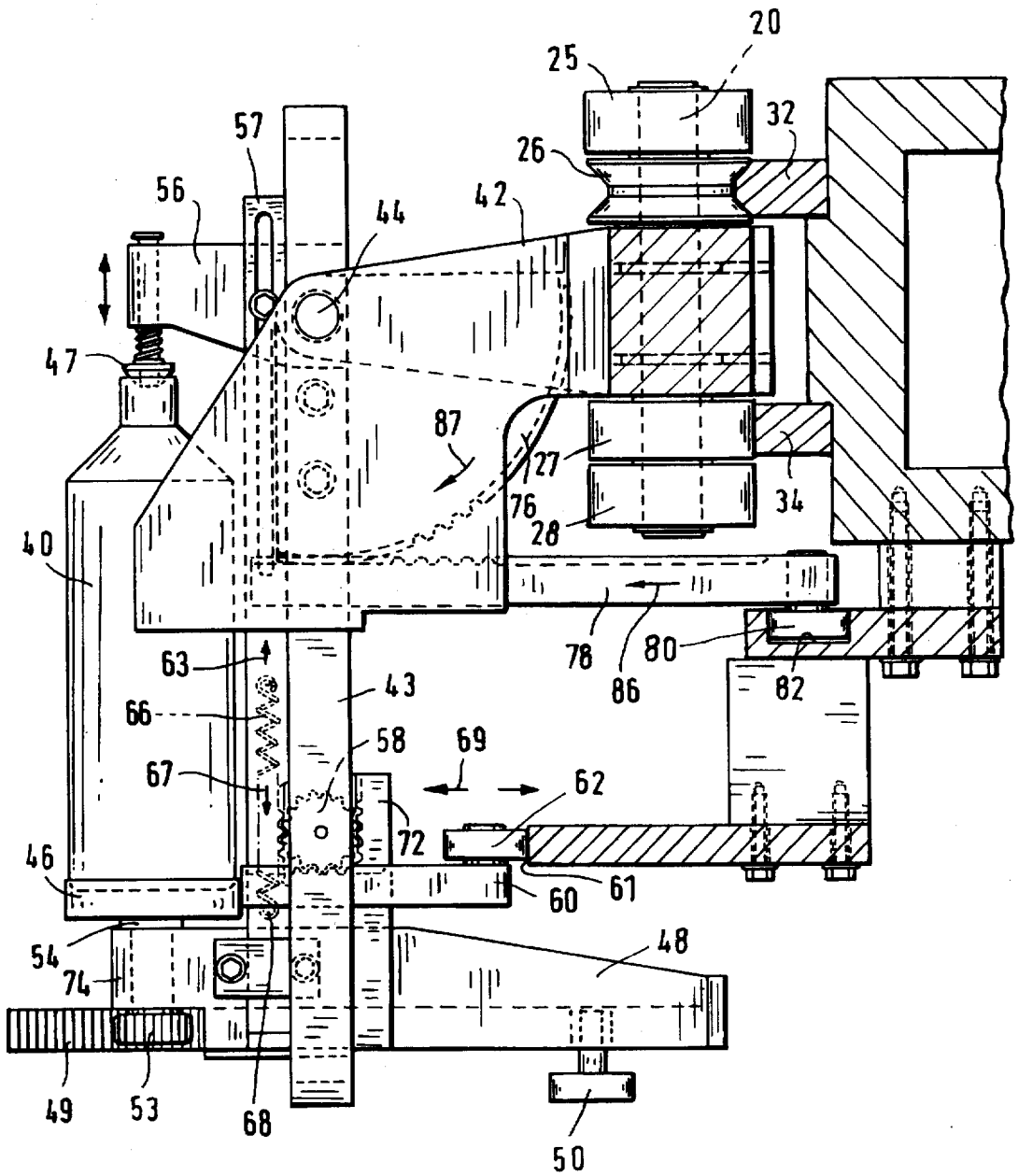
FIG. 6 is a view approximately in the direction of the arrows VI—VI in FIG. 1, the article carrier being shown in a vertical position which it assumes approximately when reaching the line VI—VI.

Looking now also at FIGS. 3, 5 and 6 each connecting pin 20 is provided at its upper and lower ends with a respective extension portion which serves to mount rotatable guide rollers 25, 26, 27 and 28 of which the guide roller 25 co-operates with a guide rail 30 which defines the transport path on the outside thereof in the region of the two linear portions 15 and 16. The peripheral surface of the guide roller 26 is provided with a peripherally extending V-shaped groove, as can be clearly seen for example from FIG. 3. It is guided along an inner, correspondingly profiled guide rail 32, in which respect the V-shaped profiling simultaneously serves also for vertically guiding the roller 26 and therewith the entire transport means 10 formed by the plurality of interconnected racks 12. The guide rail 32 extends over the entire length of the transport path 15, 16, 18, 19.

The two lower guide rollers 27 and 28 respectively cooperate with inwardly and outwardly arranged guide rails 34 and 35 of which the guide rail 34 also extends continuously over all transport path portions 15, 16, 18, 19 whereas the outwardly disposed guide 35 is provided only in the region of the two linear transport path portions 15 and 16.

FIG. 3 in particular shows that the vertical spacing between the two inwardly disposed guide rails 32 and 34 is greater than the vertical extent of the racks 12, which is also not increased in the connecting region, so that as a result the racks 12, in the curved transport path portions 18, 19, can also adopt positions in which they are disposed between the two guide rails 32 and 34. A corresponding consideration also applies in regard to the two outer guide rails 30 and 35 which are at an even greater vertical spacing from each other. The polygonal configuration of the racks 12 in the region of the curved transport path portions 18, 19 is immaterial in terms of the transportation movement of the transport means as the guidance action is afforded by way of the connecting pins 20 on the guide rails 32 and 34 which can be shaped in such a way, for example being of a semi-circular configuration, that they ensure smooth steady movement of the transport means.

In the embodiment illustrated in the drawing, the drive of the transport means 10 is produced independently of the guide arrangement by a rotary gear 36 which can be clearly seen in FIG. 1 within the transport path 15, 16, 18, 19. The gear 36 comes into engagement with the inwardly facing tooth arrangements on the respective racks 12, and it is driven in rotation by a drive shaft 37. It will be seen from FIG. 8 that the mutually overlapping parts of the two adjacent racks 12 which are connected together by the respective pin 20, that is to say the fork portion 22 of the one rack 12 and the end portion 24 of reduced thickness of the respective other rack 12, are also provided with a tooth arrangement and consequently the drive gear 36 also simultaneously comes into engagement with both interconnected racks, in the connecting region thereof, as can also be clearly seen from the interrelationship in FIG. 1 between the gear 36 and the racks 12 co-operating therewith in that position. That design configuration presupposes that the teeth in the fork portion 22 of the one rack 12 and the end portion 24 of the adjoining rack 12 are arranged in alignment with each other, that is to say congruent in plan view, in the assembled condition. The fact that the drive gear 36 is in engagement with both adjoining racks 12 in the connecting regions afforded by the connecting pivots 14 provides a smooth transition from one rack 12 to the respective following rack 12 at the drive gear 36 and thus provides for particularly smooth movement of the transport means 10.

As a modification of the configuration shown in FIG. 1 it is also possible to provide more than only one drive gear 36. That will be desirable and may even be necessary in particular if the transport means 10 is of a substantially greater length than in the embodiment illustrated in the drawing. A second gear could be associated with the other linear transport path portion and could come into engagement with the racks 12 there.

Reference numeral 39 denotes article carriers for articles 40 to be decorated or printed upon, which in the case of the illustrated embodiment are by way of examples bottles, that are pivotably mounted on the outside to the respective racks 12. For that purpose, as can be seen in particular from FIGS. 3 through 6, each rack 12 is provided at its outer side remote from its tooth arrangement with cantilevered projecting carrier arms 42, on which a plate 43 is pivotably supported by way of a pivot pin 44. The plate 43 carries first and second holding portions 46, 47 for an article 40 to be printed on or decorated, of which the holding portion 46 receives the bottom of the article or bottle 40 in the usual manner and the holding portion 47 is in the form of a bar-like member which engages into the mouth of the neck of the bottle.

Figure 2:
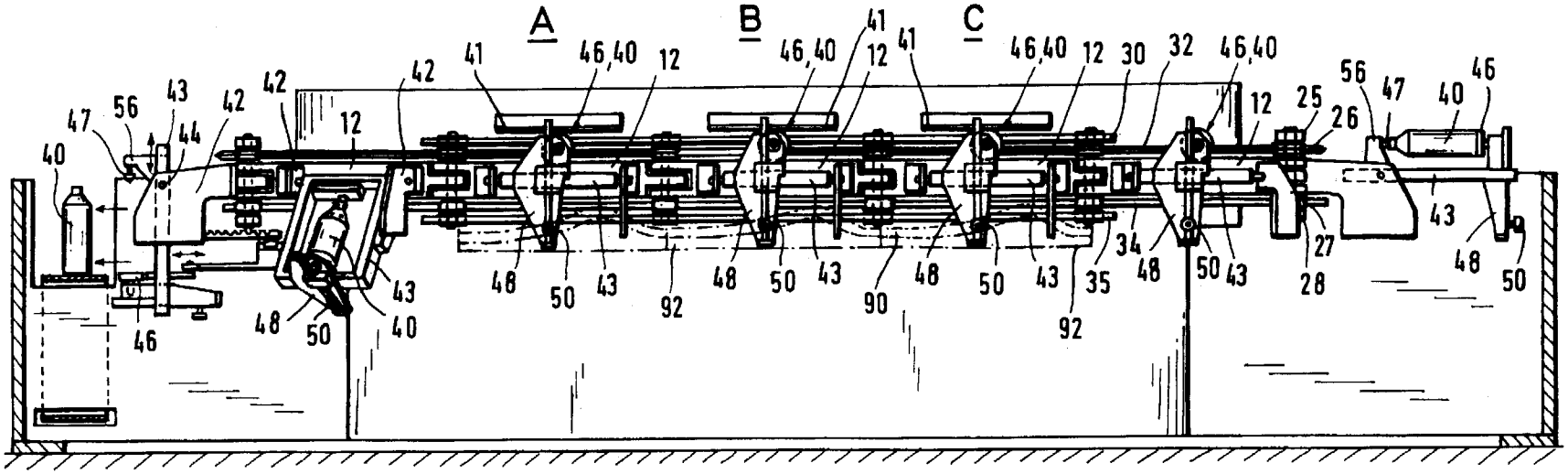
FIG. 2 is a side view taken approximately along line II—II in FIG. 1.

It will be noted at this point that the illustrated embodiment of the apparatus according to the invention is provided with six printing stations referenced A, B, C, D, E and F in FIG. 1 with each of which is associated a respective screen printing mechanism. For reasons of clarity of the drawing FIG. 1 does not show those screen printing mechanisms which are of a conventional design configuration and which can be provided with a screen printing stencil as diagrammatically indicated at 41 in FIG. 2 and at least one squeegee or doctor (not shown). In addition the apparatus is provided with an article-feed station K at which the articles or bottles to be decorated or printed upon are guided between the holding portions 46, 47 of the respective article carrier 39 at that station K, and a removal station G in which the printed or decorated articles such as bottles are removed from the respective article carrier 39. Associated with both stations G and K is a common conveyor belt 65 which feeds the apparatus with the articles or bottles to be decorated, in an upright position, and which transports away the decorated articles or bottles, also in an upright position. In the stations G and K and on the way from the station G to the station K the article carrier 39 assumes the position shown in FIG. 6 in which it and the article or bottle 40 held by the holding portions 46, 47 extend vertically.

Figure 4:
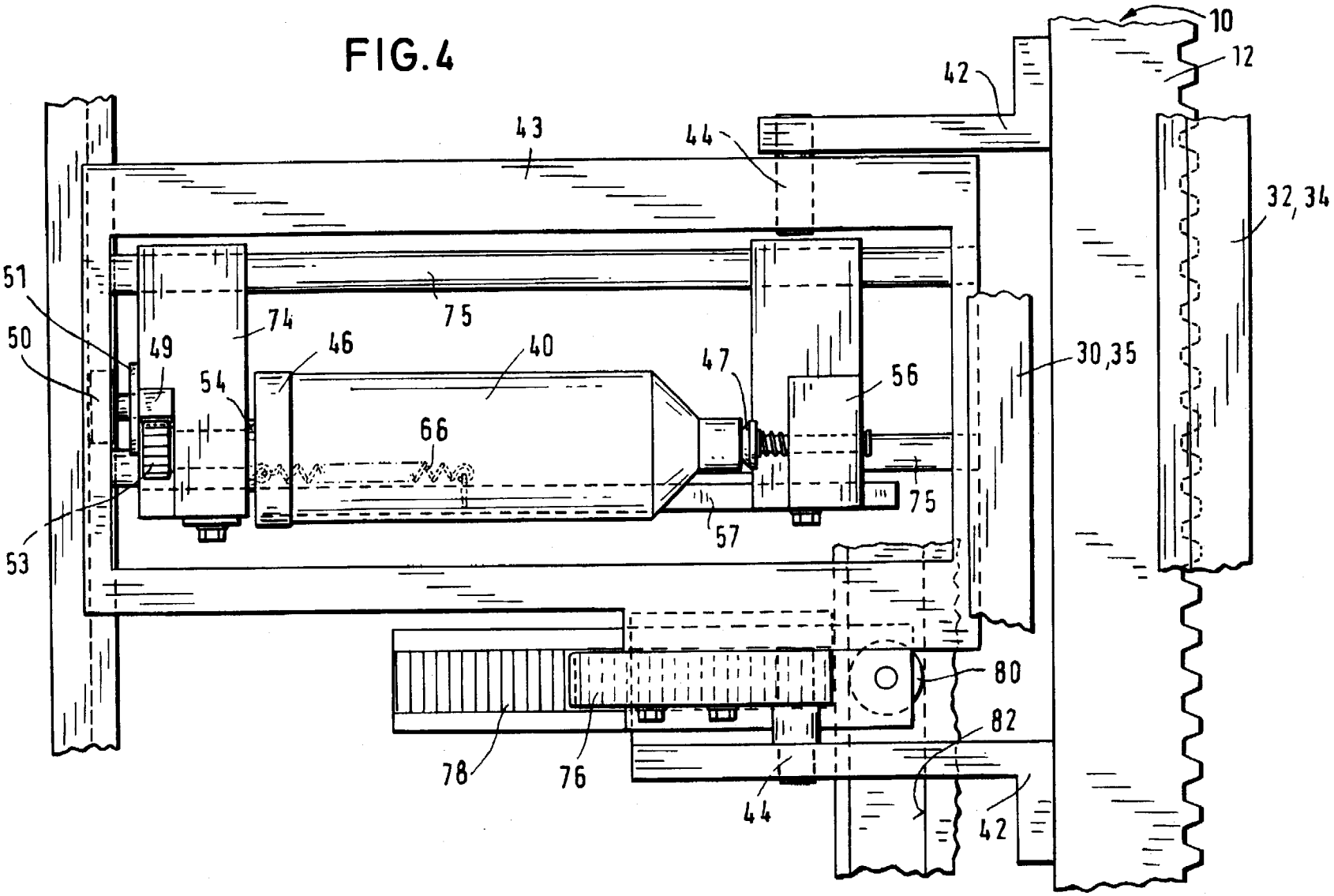
FIG. 4 is a view approximately in the direction of the arrow IV in FIG. 3.

During the printing operation the article carrier 39 assumes the position illustrated in FIGS. 3 through 5 in which the longitudinal axis of the respective article or bottle 40 extends substantially horizontally. That always applies when the surface to be printed upon extends in longitudinal section parallel to the longitudinal axis of the article. It is however also possible to decorate or apply printing to such surfaces which are conical, that is to say which in longitudinal section extend at an acute angle relative to the longitudinal axis of the article. In that case the article carrier 39 would be moved into an inclined position, the angle thereof relative to the horizontal corresponding to the conical angle of the surface to be decorated.

For the purposes of producing the pivotal movements between the position of the article carrier 39 as shown in FIG. 6 on the one hand and the horizontal position as shown in FIGS. 3 through 5 on the other hand, fixedly mounted on the pivot pin 44 to which the plate 43 is fixedly connected is a toothed segment 76 engaging with a rack 78 which at one end carries a cam roller 80. The roller 80 co-operates with a stationary cam means 82 which extends along the entire transport path of the apparatus. When the cam means 82 is of a suitable configuration in the direction of transportation movement 11 of the article carrier 39, in the course of the transportation movement the rack 78 is displaced for example in the direction indicated by the arrow 86 in FIG. 6 so that the segment 76 is rotated in the direction indicated by the arrow 87 in FIG. 6, that is to say in the clockwise direction. In that case, the article carrier 39 is pivoted from the vertical position shown in FIG. 6 into the horizontal position or, if necessary, into an intermediate position. Corresponding actuation of the rack 78 by the cam means 82 in the opposite direction would result in rotary movement of the segment 76 in the direction indicated by the arrow 89 in FIG. 3, that is to say, in the counter-clockwise direction, and would pivot the article carrier 39 from the substantially horizontal position, or an intermediate position, into its vertical position.

It will be seen that the pivot pin 44 also carries a L-shaped profile portion 84 in which the rack 78 is mounted for displacement in its longitudinal direction. The profile portion 84 does not take part in the pivotal movements of the article carrier 39.

Figure 10:
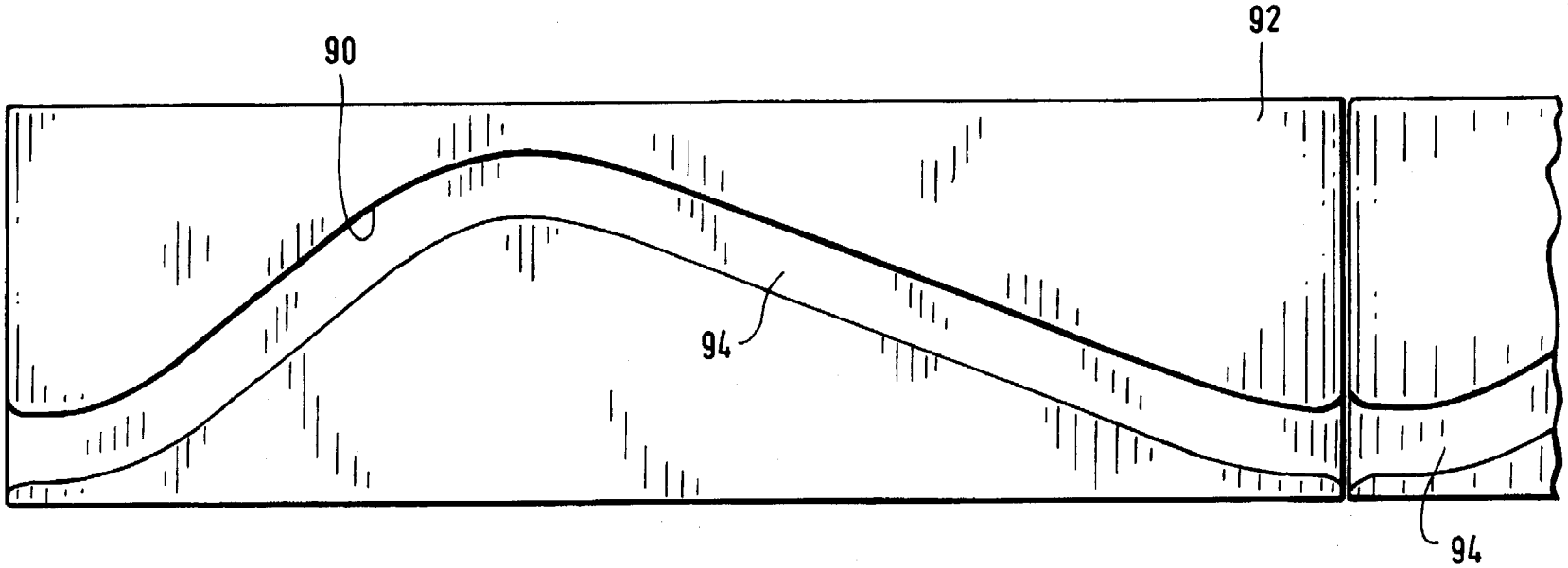
FIG. 10 is a side view of a cam portion associated with a treatment station.

At its end remote from the pivot pin 44, the article carrier 39 is provided with a portion or component 48 which extends substantially perpendicularly relative to the plane of the plate 43 and which serves for mounting and guiding a reciprocal rack 49 and which for that purpose is provided with an opening that is covered by a releasable guide and holding portion indicated in the form of a plate 51. In its lower region the rack 49 carries a cam roller 50 and is in engagement by way of its teeth with a gear 53 fixedly connected to a shaft 54 to which is fixed the holding portion 46 for carrying the bottom region of the article 40. The shaft 54 determines the axis about which the article 40 is rotated for example during the printing or decorating operation. In the embodiment illustrated in the drawing showing an article 40 of circular cross-section, the longitudinal axis of the article 40 is at the same time the axis of rotation so that the longitudinal axis extends coaxially with respect to the gear 53 and the shaft 54. It will be seen therefore that the appropriate rotary movements of the article 40 are produced by corresponding upward and downward movements of the rack 49. Those movements are transmitted to the respective rack 49 by the cam roller 50. For that purpose, the illustrated embodiment of the apparatus is provided with a cam means 90, as shown in FIGS. 1 and 10, extending along the linear transport path portions 15, 16 at which the printing stations are disposed.

The cam means 90 comprises interconnected portions 94, of which a respective portion is mounted on a respective plate 92. The plates 92 are arranged in a vertical plane and in parallel relationship with the linear transport path portions 15 and 16 respectively in such a way that the cam means composed of the portions 94 is towards the respective transport path portions and the cam roller 50 of the rack 49 of each article carrier 39 can engage into the cam means 90 of the respective transport path portion 15 and 16. Associated with each station in which the article 40 experiences a rotational movement about its longitudinal axis, that is to say more particularly the printing stations A–F, is a respective cam portion 94, whose configuration is determined by the required rotational movement of the object and therewith the longitudinal movements, which are required for that purpose, of the respectively associated rack 49. If the rotational movements performed by each article in the stations A–F are the same, the cam portions 94 of the respective cam means 90 are also the same. It is however also possible for the articles to perform different rotational movements in the individual stations so that the apparatus may possibly also have different cam portions 94. In the event of a change for example from one type of article of a given diameter to another type of article of a different diameter, it is necessary at any event if the transport means 10 is moved at unaltered speed for the cam means 90 or the portions 94 thereof to be altered so as to guarantee a peripheral speed for the article, which corresponds to the speed of transportation movement produced by the transport means 10. In general it will be desirable for the screen printing stencils in the printing stations to be kept stationary during the printing procedure. It would however also be possible for the screen printing stencil to be additionally moved during the printing operation, in the direction of transportation movement of the articles or in the opposite direction, although in the case of high-output machines with a transport means which moves at high speed, the endeavour will generally be to minimise the masses that are to be moved, and as far as possible to avoid mass movements in mutually opposite directions. It will be appreciated that it is necessary for the squeegees or doctors (not shown) to be reciprocated during the printing operation with the article to be printed upon at any event if the screen printing stencil is arranged to be stationary. However the masses involved in such reciprocating movements are small so that they are not a significant factor.

Adaptation to different dimensions in respect of the types of articles to be decorated, for example bottles, can be effected by suitable adjustment in respect of height of the printing mechanisms, as is generally known procedure. As the cam means 90 are only associated with the two linear transport path portions 15, 16, care should possibly be taken to ensure that, in the arcuate transport path portions 18, 19, a change in the position of the rack 49 and therewith a change in the angular position of the holding portions 46, 47 and the article 40 held thereby is prevented, or it is guaranteed in some other way that, when the respective article carrier 39 passes into the respective linear transport path portion 15 or 16, the cam roller 50 is correctly aligned in relation to the cam means 90 which begins at that location. That can be achieved on the one hand by the additional provision in the arcuate transport path portions 18 and/or 19 of a cam means which makes the connection between the cam means 90 of each of the linear transport path portions 15 and 16. On the other hand, it is also possible to provide means for holding the guide roller 50 and therewith the rack 49 in the position which is adopted by the two members after passing each of the printing stations C and F respectively. That could be effected for example by magnetic means which are mounted on the article carrier 39.

In order to bring the article to be printed upon in the receiving station K between the two holding portions 46 and 47 and later to remove the printed article from the holding portions 46 and 47, the spacing between the two holding portions 46 and 47 is variable. Looking at FIG. 3, for that purpose the holding portion 47 is mounted longitudinally displaceably on a support bracket 56 which is carried longitudinally adjustably by a rack 57 which is mounted on the article carrier 39 longitudinally displaceably in parallel relationship with the longitudinal axis of the article 40. In addition a second rack 72 which extends parallel to the first rack 57 at a short spacing therefrom is longitudinally displaceably mounted on the article carrier 39. It supports the member 74 on which the holding portion 46 for holding the bottom of the article or bottle 40 is rotatably mounted. The two racks 57 and 72 are in engagement with a common pinion as indicated at 71 in FIG. 5 which is driven by way of a shaft indicated at 70 in FIG. 5 by a pinion indicated at 58 in FIGS. 3, 5 and 6.

The pinion 58 is driven by a rack 60 which extends substantially perpendicularly relative to the racks 57 and 72 and which extends substantially horizontally when the article carrier 39 is positioned substantially vertically, as shown in FIG. 6. Mounted on the rack 60 is a cam roller as shown at 62 which, in the regions, that is to say in particular in the article-feed station and in the removal station, in which a change in the spacing between the two holding portions 46, 47 of an article carrier 39 is required, is guided at a cam means as indicated at 61 in FIG. 6, whose configuration in the direction 11 of transportation movement of the article carrier 39 is so selected that reciprocating movements according to the requirements involved are transmitted to the rack 60, and such movements result in corresponding rotational movements of the pinion 58 which drives the pinion 71 by way of the shaft 70. A movement of the rack 60 in the direction of the arrow indicated at 69 in FIG. 6 results in a rotary movement of the pinions 58 and 71 in the clockwise direction. That causes displacement of the rack 57 in the direction of the arrow 63, in which case the holding portion 47 is also displaced in the direction of the arrow 63 by virtue of the connection between the holding portion 47 by way of the support bracket 56 to the rack 57. That longitudinal displacement is effected against the force of a tension spring 66 in FIG. 6, of which one end is fixed to the rack 57 and the other end is fixed to a mounting such as a pin 68 or the like on the end member 48 of the article carrier 39. At the same time the rack 72 is displaced by the pinion 71 in the opposite direction, that is to say in the direction indicated by the arrow 67 in FIG. 6. The opposite movements of the two racks 57 and 72 increase the spacing of the two holding portions 46 and 47. Upon a movement of the rack 60 in the opposite direction to the direction 69, the spacing of the two holding portions 46 and 47 is accordingly reduced. The two members 74 and 56 which carry the holding portions 46 and 47 are guided on two bars as indicated at 75 in FIG. 5, which are disposed on the article carrier 39 substantially parallel to the longitudinal axis of the article 40.

As the force exerted by the tension spring 66 acts in the direction of closing of the two holding portions 46, 47 and the two racks 57 and 72 are interconnected by the pinion 71, the cam means 61 only needs to apply forces to the cam roller 62 in the opening direction. There is therefore no need for a cam means for applying forces to the cam roller 62 in the opposite direction to the arrow 69. The tension spring 66, in the form illustrated as a coil spring, which extends substantially parallel to the two racks 57 and 72, also serves to hold the two holding portions 46 and 47, under a resilient prestressing, in the closed operative position in which the article 40 is held by the two holding portions 46 and 47. There is therefore no need to associate with the cam roller 62 a cam means 61 which extends over the entire transport path 15, 16, 18, 19. On the contrary it is sufficient to provide the cam means 61 only in the region of the removal station G and the feed station K, in such a way that in the transportation direction 11 the cam means 61 begins approximately at the location where the article carrier 39, after passing the last printing station in the transportation direction 11, and a further treatment station which is possibly arranged downstream thereof, is pivoted completely into the vertical position as shown in FIG. 6, which is also the position assumed by the article carrier 39 disposed in the left-hand apex region of the transport path in FIGS. 1 and 2. Thereafter, by suitable displacement of the cam roller 62 and therewith the rack 60, the two holding portions 46 and 47 would be moved away from each other in such a way that the article 40 held by the article carrier 39 is released by the holding portions 46, 47 at the point at which a removal device 64 has engaged the printed article 40 so that the latter no longer needs to be held by the holding portions 46, 47. Transfer of the article 40 from the article carrier 39 to the removal device 64 will take place approximately in the region of the point indicated at 88 in FIG. 1 where the path of movement of the article carrier 39 and the article 40 held thereby and the path of movement of the removal device 64 intersect, as is diagrammatically shown in dash-dotted lines in FIG. 1.

On the way from the removal station G to the feed station K the holding portions 46 and 47 can remain in their open position so that, on reaching the feed station K, an article 40 to be printed upon can be moved between the two holding portions 46, 47 by a feed device 73, whereupon, by virtue of the cam means 61 being of a suitable configuration, the cam roller 62 can be displaced by the force of the spring 66 in the opposite direction to the arrow 69 with the result that the spacing between the two holding portions 46, 47 is reduced until they firmly hold the article 40 between them. That occurs approximately at the point indicated at 89 in FIG. 1 where the path of movement of the article carrier 39 or the holding portions 46, 47 and the path of movement of the article 40 fed by the feed device 73 intersect. After the closing movement of the two holding portions 46, 47 is concluded, the cam means 61 can end as, over the remaining transportation distance through the stations A–F, the holding portions 46, 47 are held in the closed operative condition by virtue of the force of the spring 66. On the way from the station K until reaching the linear transport path portion 15 the article carrier 39 is then again pivoted upwardly by suitable actuation of the toothed segment 76 by the cam means 82 and the cam roller 80 associated therewith, into the position, being a horizontal position in this case, for performing the printing operations which begin with the application of a first print image at the station A.

It will be noted that the removal device 64 and the feed device 73 are not a constituent part of the subject-matter of the present invention and they have therefore not been described in full detail herein but any suitable form of device for performing the functions clearly indicated above will be appropriate in this context.

It will be appreciated that the above-described apparatus according to the present invention has been set forth solely by way of example and illustration of the invention and that various other modifications and alterations may be made therein without thereby departing from the spirit and scope of the invention.

What is claimed is:

1. Apparatus for decorating articles comprising:

a transport path;

at least one article carrier movable along the transport path;

at least one article-decorating station;

a station at which an article to be decorated is fed to the article carrier;

a station at which a decorated article is removed from the article carrier;

a circulating transport means for the at least one article carrier, the transport means circulating in a substantially horizontal plane and comprising a plurality of rigid elongate portions and connecting means connecting the transport portions together pivotably in the plane in which the transport means circulates, each said transport portion having tooth means, at least one drive means having tooth means engaging with the tooth means of at least one said transport portion of the circulating transport means for moving the transport means along said transport path, and at least one guide means defining at least a portion of the transport path, the transport portions of the transport means being guided at said guide means by way of connecting means pivotably interconnecting each two adjacent transport portions.

2. Apparatus as set forth in claim 1 wherein the transport portions comprise respective racks and wherein said drive means comprises at least one gear drivably engaging said racks.

3. Apparatus as set forth in claim 1 wherein said transport means is adapted to circulate continuously.

4. Apparatus as set forth in claim 1 wherein each two interconnected transport portions in the connecting region thereof have mutually overlapping regions provided with identical tooth means.

5. Apparatus as set forth in claim 1 wherein the transport path comprises first and second at least substantially linear, mutually parallel, spaced-apart portions and first and second curved portions connecting the mutually parallel portions, and wherein at least one operating station is associated with each of the substantially linearly portions.

6. Apparatus as set forth in claim 5 wherein said drive means includes at least one drive gear and wherein the at least one drive gear is operatively associated with a respective said linear portion of said transport path.

7. Apparatus as set forth in claim 1 wherein each said transport portion is of a length of between about 200 mm and 1000 mm.

8. Apparatus as set forth in claim 7 wherein each said transport portion is of a length of between about 500 mm and 700 mm.

9. Apparatus as set forth in claim 1 wherein the connecting means for connecting the pivotably interconnected transport portions are provided with rotatable guide means adapted to co-operate with at least one of said guide means.

10. Apparatus as set forth in claim 9 wherein each said transport portion has holes adjacent respective ends thereof, wherein said connecting means are each in the form of a pin extending through said holes in the two adjacent transport portions to be connected together, wherein each said pin has at least one extension portion projecting relative to the respective adjacent connected transport portions, and further including at least one guide member on said extension portion and co-operable with said guide means.

11. Apparatus as set forth in claim 10 wherein each said pin projects with respect to said interconnected transport portions above and below same and is provided with at least one guide roller means on each said extension portion formed thereby.

12. Apparatus as set forth in claim 10 wherein at least one of said guide roller means has a peripheral surface having a peripherally extending groove therein and wherein said guide means includes at least one guide rail co-operating with said guide roller means and correspondingly profiled at its surface co-operable with said guide roller means such that there is positively locking engagement between said guide roller means and the guide rail co-operable therewith.

13. Apparatus as set forth in claim 12 wherein said guide rail providing said positively locking engagement is arranged at the inside of the guide path extending therearound over the entire length thereof.

14. Apparatus as set forth in claim 1 wherein each said transport portion has an article carrier.

15. Apparatus as set forth in claim 14 wherein each article carrier is mounted pivotably in a vertical plane on the respective transport portion.

16. Apparatus as set forth in claim 15 wherein during an article-decoration operation said article carrier assumes a position such that the longitudinal axis of an article carried thereby extends substantially horizontally.

17. Apparatus as set forth in claim 15 wherein during an article-decoration operation the article carrier assumes a position such that the longitudinal axis of an article carried thereby forms an acute angle with the horizontal.

18. Apparatus as set forth in claim 15 wherein in at least one of the feed station and the removal station for the articles the article carrier assumes a position in which the longitudinal axis of an article carried thereby extends substantially vertically.

19. Apparatus as set forth in claim 1 wherein said article carrier has first and second holding portions adapted to receive a said article and means mounting said holding portions rotatably about an axis parallel to the longitudinal axis of an article carried thereby, and further including an actuating means provided with tooth means, means mounting the actuating means reciprocably on the article carrier, a gear engaging with the tooth means on the actuating means, whereby reciprocal displacement of said actuating means causes rotary movement of said gear, and means connecting said gear to said holding portions, for the purposes of transmission of a rotary movement to the holding portions.

20. Apparatus as set forth in claim 19 and further including cam means provided along at least a portion of said transport path and adapted to operate said actuating means for driving said gear to rotate said holding portions, whereby in the course of the transport movement along said transport path said cam means transmits to the actuating means movements which correspond to the rotational movement performed by a said article in a decoration station.

21. Apparatus as set forth in claim 19 and further including cam means provided along at least a portion of said transport path and adapted to operate said actuating means for driving said gear to rotate said holding portions, whereby in the course of the transport movement along said transport path said cam means transmits to the actuating means movements which correspond to the rotational movement performed by a said article between first and second successive decoration stations.

22. Apparatus as set forth in claim 19 including fixing means for fixing said actuating means in a given position.

23. Apparatus as set forth in claim 22 wherein said fixing means includes magnet means.

* * * * *